US006366186B1

(12) United States Patent
Hill et al.

(10) Patent No.: US 6,366,186 B1
(45) Date of Patent: Apr. 2, 2002

(54) MEMS MAGNETICALLY ACTUATED SWITCHES AND ASSOCIATED SWITCHING ARRAYS

(75) Inventors: Edward A. Hill; Ramaswamy Mahadevan, both of Chapel Hill, NC (US)

(73) Assignee: JDS Uniphase Inc., San Jose, CA (US)

( * ) Notice: Subject to any disclaimer, the term of this patent is extended or adjusted under 35 U.S.C. 154(b) by 0 days.

(21) Appl. No.: 09/487,976

(22) Filed: Jan. 20, 2000

(51) Int. Cl.[7] ..... H01H 51/22
(52) U.S. Cl. ..... 335/78; 257/421
(58) Field of Search ..... 335/78–86, 128; 200/181; 257/414, 421–424

(56) References Cited

U.S. PATENT DOCUMENTS

| | | | | | |
|---|---|---|---|---|---|
| 3,984,794 | A | * | 10/1976 | Beavitt | 335/154 |
| 5,051,643 | A | * | 9/1991 | Dworsky et al. | 310/309 |
| 5,367,136 | A | | 11/1994 | Buck | 200/600 |
| 5,367,585 | A | * | 11/1994 | Ghezzo et al. | 385/23 |
| 5,398,011 | A | * | 3/1995 | Kimura et al. | 335/79 |
| 5,475,318 | A | | 12/1995 | Marcus et al. | 324/762 |
| 5,544,001 | A | | 8/1996 | Ichiya et al. | 361/233 |
| 5,742,012 | A | * | 4/1998 | Franzke et al. | 200/5 A |
| 5,872,496 | A | * | 2/1999 | Asada et al. | 335/78 |
| 5,889,452 | A | * | 3/1999 | Vuilleumier | 335/80 |
| 5,955,817 | A | * | 9/1999 | Dhuler | 310/306 |
| 6,040,749 | A | * | 3/2000 | Youngner et al. | 335/78 |

* cited by examiner

*Primary Examiner*—Lincoln Donovan
(74) *Attorney, Agent, or Firm*—Myers Bigel Sibley & Sajovec

(57) ABSTRACT

A MEMS electrical cross-point switch is provided that includes a microelectronic substrate, a magnetic element attached to the microelectronic substrate that is free to move in a predetermined direction in response to a magnetic field and an electrical element connected to the magnetic element for movement therewith to selectively switch electric current. In one embodiment the magnetic element and the electrical element are connected via a tethering device that acts as a platform for the magnetic and electrical elements. The electrical cross-point switch may also comprise a clamping element that serves to lock the switch in an open or closed position to circumvent the magnetic actuation of the switch. In another embodiment, the invention provides for a MEMS electrical cross-point switching array that includes a microelectronic substrate, a magnetic field source in circuit with said microelectronic substrate, a plurality of first and second electrical lines disposed on the microelectronic substrate in an array formation, and a plurality of the in-plane MEMS electrical cross-point switches as described above disposed at the cross point of a first and second electrical line. In one embodiment the array is configured in a N×N or N×M array having a series of crossing first and second electrical load lines. In another configuration the array has a series of first electrical load lines that extend radially from a central point of reference and a series of second electrical load lines that extend outward, in spoke-like fashion, from the central point of reference.

23 Claims, 13 Drawing Sheets

A-A'

A-A'

B-B'

MEMS MAGNETICALLY ACTUATED SWITCHES AND ASSOCIATED SWITCHING ARRAYS

FIELD OF THE INVENTION

The present invention relates generally to microelectromechanical system (MEMS) devices and, more particularly, to MEMS magnetically actuated switches and associated switching arrays.

BACKGROUND OF THE INVENTION

Microelectromechanical systems (MEMS) have recently been developed as alternatives for conventional electromechanical devices such as relays, actuators, valves and sensors. MEMS devices are potentially low cost devices, due to the use of simplified microelectronic fabrication techniques. New functionality may also be provided because MEMS devices can be physically much smaller than conventional electromechanical devices.

Many potential applications of MEMS technology utilize MEMS acuators. For example, many sensors, valves and positioners use actuators for movement. If properly designed, MEMS actuators can produce useful forces and displacement, while consuming reasonable amounts of power. MEMS actuators, in the form of microcantilevers, have been used to apply rotational mechanical force to rotate micromachined springs and gears. Piezoelectric forces have also been employed to controllably move micromachined structures. Additionally, controlled thermal expansion of actuators or other MEMS components has been used to create forces for driving microdevices. One such thermal actuator is disclosed in U.S. Pat. No. 5,475,318 entitled "Microprobe" issued Dec. 12, 1995 in the name of inventors Marcus et.al., which describes leveraging thermal expansion to move microdevices.

Micromachined MEMS electrostatic devices have been created which use electrostatic forces to operate electrical switches and relays. Various MEMS relays and switches have been developed which use relatively rigid cantilever members, or flexible flaps separated from the underlying substrate in order to make and break electrical connections. Examples of such rigid cantilever MEMS electrostatic devices are disclosed in U.S. Pat. No. 5,367,136, entitled "Non-Contact Two Position Microelectronic Cantilever Switch", issued Nov. 22, 1994, in the name of inventor Buck and U.S. Pat. No. 5,544,001, entitled "Electrostatic Relay", issued Aug. 6, 1996, in the name of inventors Ichiya et. al. Additionally, an example of an electrostatic MEMS switch embodying a flexible type flap arrangement is disclosed in U.S. patent application No. 09/345,722, entitled "High Voltage Micromachined Electrostatic Switch" filed on Jun. 30, 1999, in the name of inventor Goodwin-Johansson, and assigned to the same entity as the invention herein disclosed.

While magnetic fields, and more specifically electromagnetic fields, have also been used to drive micromotors and to activate switches, typically previous use of magnetic fields has dictated that each micromotor or switch have an individual magnetic field associated with it. For example, conventional MEMS switching matrix have included individual microcoils or electromagnets to drive each individual switch element in the array, thereby resulting in an undesirably large and complex switch. The size and complexity of the switch are particularly troublesome, as the switching matrix becomes large, as demanded by some applications. In addition, most conventional switching matrices are limited to in-plane operation. As such, the need exists to create MEMS magnetically actuated switches that can be actuated in an in-plane or out-of-plane direction to accommodate switches capable of directing current from and to electrical load lines disposed on a single microelectronic substrate and from and to electrical load lines disposed on two distinct microelectronic substrates.

As such, a need exists to provide MEMS magnetically actuated switches and corresponding switching arrays that are capable of individual activation in a single magnetic field environment. This benefit can be realized in easier fabrication of large scale switching arrays that occupy less space on the microelectronic substrate. These benefits are particularly attractive since switching devices and the associated arrays are highly desirable in today's telecommunications and test equipment industries.

SUMMARY OF THE INVENTION

A MEMS magnetically actuated cross point switch and associated switching arrays are therefore provided that are capable of providing in-plane and out-of-plane actuation while occupying minimal area on the microelectronic substrate. Additionally, the MEMS magnetically actuated cross point switch of the present invention provides for a concise array that can be actuated by a single external magnetic field source.

The MEMS electrical cross-point switch includes a microelectronic substrate, a magnetic element attached to the microelectronic substrate that is free to move in a predetermined direction in response to a magnetic field and an electrical element connected to the magnetic element for movement therewith to selectively switch electric current. In operation, the magnetic element is in communication with a magnetic flux path and seeks to align with the magnetic field across the flux path to create the actuation force. The actuation force drives the electrical element to electrically connect with a proximate electrical load path. In one embodiment the magnetic element and the electrical element are connected via a tethering device that acts as a platform for the magnetic and electrical elements. The electrical cross-point switch may also comprise a clamping element that serves to lock the switch in an open or closed position to circumvent the magnetic actuation of the switch.

In another embodiment, the invention provides for a MEMS electrical cross-point switching array that includes a microelectronic substrate, a magnetic field source in circuit with said microelectronic substrate, a plurality of first and second electrical lines disposed on the microelectronic substrate in an array formation, and a plurality of the in-plane MEMS electrical cross-point switches as described above disposed at the cross point of a first and second electrical line. In one embodiment the magnetic elements and the electrical elements of the individual switches are connected via tethering devices that act as platforms for the magnetic and electrical elements. The individual electrical cross-point switches may also comprise clamping elements that serve to lock the switch in an open or closed position to circumvent the magnetic actuation of the switch when the magnetic field source is applied to the array. In one embodiment the array is configured in a N×N or N×M array having a series of crossing first and second electrical load lines. In another configuration the array has a series of first electrical load lines that extend in circular arcs from a central point of reference and a series of second electrical load lines that extend outward, in a radial spoke-like fashion, from the central point of reference. In both embodiments switch elements are located at the cross point of the intersecting first and second electrical load lines.

In another embodiment the MEMS magnetically actuated cross-point switch includes a microelectronic substrate and a magnetic element attached to the microelectronic substrate and free to move in a predetermined direction in response to a magnetic field to selectively switch electric current from a magnetically conductive first electrical line to a second electrical line. In this embodiment the electrical load path and the magnetic flux path are shared, such that magnetic actuation of the magnetic element results in the select switching of electric current from one electrical load line to another. In this embodiment, a clamping element may be employed to lock the switch in an open or closed position to circumvent the magnetic actuation of the switch. In another embodiment a corresponding MEMS magnetically actuated switching array is provided that includes the MEMS switches described above.

In yet another embodiment, an out-of-plane MEMS magnetically actuated cross-point switch includes a first microelectronic substrate and a first contact plate disposed on the first microelectronic substrate that is magnetically moveable. This switch also comprises a second microelectronic substrate positioned in a spaced apart relationship with the first microelectronic substrate. The second microelectronic substrate has disposed thereon a second contact plate located proximate to the first contact plate, wherein the selective magnetic actuation of the first contact plate results in the switching of electrical current from the first contact plate to the second contact plate. In this dual substrate embodiment the second contact plate on the second substrate may be capable of magnetic actuation or the second contact plate may be a stationary entity. In this embodiment, a clamping element may be employed to lock the first contact plate in an open or closed position to circumvent the magnetic actuation of the switch. In an alternate embodiment an array of the above described switches can be formed on the first and second substrates to selectively change current from a series of first electrical load lines on the first substrate to a series of second electrical load lines disposed on the second electrical substrate.

Additionally, a method for MEMS electrical switching is provided that includes the steps of applying a magnetic field to a magnetically actuated MEMS electrical cross-point switch, attracting a magnetic element of the switch toward the magnetic field, actuating an electrical element connected to the magnetic element and switching electric current. Additionally, the method may provide for clamping the switch prior to application of the magnetic field to lock the switch in an open or closed state.

As such, the present invention provides for a MEMS magnetically actuated switch and corresponding switching arrays that are capable of individual activation in a single magnetic field environment. This benefit is realized in easier fabrication of large scale switching arrays that occupy less space on the microelectronic substrate.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
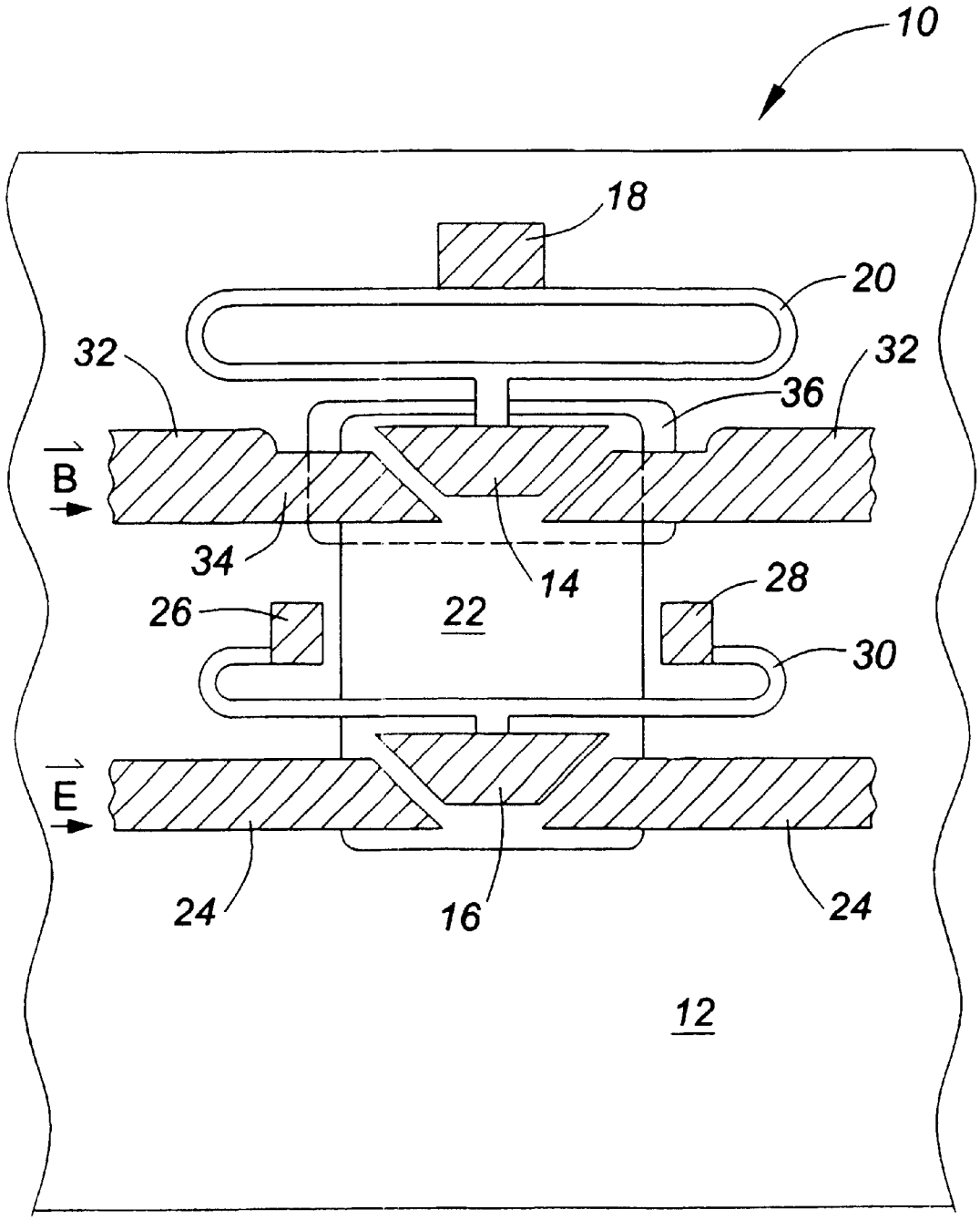
FIG. 1 is a plan view of an in-plane MEMS magnetically actuated switch in accordance with an embodiment of the present invention.

FIG. 1 is a plan view illustration of a MEMS magnetically actuated switch 10 in accordance with an embodiment of the present invention. The switch comprises a microelectronic substrate 12, a magnetic element 14 attached to the microelectronic substrate and an electrical element 16 connected to the magnetic element. The microelectronic substrate is typically formed of silicon or any other similar microelectronic substrate material may be used. The magnetic element is free to move in a predetermined direction in response to the application of a magnetic field. Movement of the magnetic element corresponds with movement of the connected electrical element to thereby selectively switch electric current.

In the embodiment shown in FIG. 1 the magnetic element 14 may comprise nickel, a nickel/iron alloy or another suitable magnetic material. The generally trapezoidal plan view shape of the magnetic element is shown by way of example only. The magnetic element may be fabricated in any shape that allows for the magnetic element to align with an applied magnetic field and move in a predetermined direction. The magnetic element is affixed to the substrate at the anchor 18. The anchor may be fabricated from a metal, a polymer or any other material capable of providing a point of attachment to the substrate. A first spring-like element 20 connects the anchor to the magnetic element and provides for the magnetic element to move freely in a predetermined direction. In a preferred embodiment, as shown, the first spring-like element may comprise a hairpin spring. While a hairpin spring provides the necessary robustness and elasticity, other spring-like elements, such as a suspension spring, may also be used to provide the magnetic element with a means for motion and a connection to the anchor. The first spring-like element may comprise a metallic material, a polyimide material, a nitride material or any other suitable flexible material.

The magnetic element 14 overlies and is, typically, attached to a tethering device 22 that serves to connect the magnetic element to the electrical element 16. The electrical element also overlies and is, typically, attached to the tethering device. In operation, magnetic actuation of the magnetic element moves the attached tethering device and the connected electrical element. The tethering device may be formed of a nitride material, an oxide material or another suitable, non-magnetic, insulating material. During fabrication of the MEMS magnetically actuated switch the tethering device is released from the underlying microelectronic substrate 12 to allow for the tethering device to move freely. The tethering device is affixed to the substrate via the anchors 18, 26 and 28 associated with the magnetic element and the electrical element. The positioning of the magnetic and electrical elements in relation to the tethering device is shown by way of example. It is also possible to position the tethering so as to overlie the magnetic and electrical elements. It is also possible and within the inventive concepts herein disclosed to construct the MEMS magnetically actuated switch using other similar structures to connect the magnetic element to the electrical element.

The electrical element 16 may comprise nickel, gold or another suitable electrically conductive material. The generally trapezoidal plan view shape of the electrical element is shown by way of example only. The electrical element may be fabricated in any shape that allows for the electrical element to make contact with the associated electrical load line 24 during switch operation. The electrical element is affixed to the microelectronic substrate via anchors 26 and 28. The anchors may be fabricated from a metal, a polymer or any other material capable of providing a point of attachment to the substrate. A second spring-like element 30 connects the anchors to the electrical element and provides for the electrical element and attached tethering device, to move freely in a predetermined direction. In a preferred embodiment, as shown, the second spring-like element may comprise a c-shaped spring. While a c-shaped spring provides the necessary robustness and elasticity, other spring-like elements, such as a suspension spring, may also be used to provide the electrical element with a means for motion and a connection to the anchor. The second spring-like element may comprise a metallic material, a polyimide material, a nitride material or any other suitable flexible material.

As illustrate in FIG. 1 a magnetic flux path 32 is disposed on the microelectronic substrate 12 and is proximate the magnetic element 14. The magnetic flux path may comprise nickel, a nickel/iron alloy or another suitable magnetic material. In operation, when a magnetic flux is applied along the magnetic flux path it serves to align the magnetic element with the line and generate a force that draws the magnetic element toward the line, thereby moving the tethering device and the connected electrical element. In the embodiment shown the magnetic flux path lies generally parallel to the microelectronic substrate and is generally perpendicular to the predetermined direction of movement of the magnetic element. As shown, the magnetic flux path may narrow at a neck portion 34 to concentrate the magnetic flux at the location proximate the magnetic element. Additionally, the magnetic flux path overlies the tethering device proximate the magnetic element but does not impede the free movement of the tethering device. To achieve the necessary attraction force in the magnetic element the magnetic flux path will typically carry a minimum magnetic field of about 200 Gauss.

The electrical load line 24 is disposed on the microelectronic substrate 12 and is proximate the electrical element 16. The electrical load line may comprise copper, gold, aluminum, polysilicon or another suitable electrically conductive material. In operation, when a magnetic flux is applied across the magnetic flux path the magnetic element and connected electrical element are actuated in a predetermined direction. The actuation of the electrical element results in contact with the electrical load line and, thus, the electrical element serves to close the electrical circuit. In the embodiment shown the electrical load line lies generally parallel to the microelectronic substrate and is generally perpendicular to the predetermined direction of movement of the electrical element. The electrical load line will typically have thicker cross-sectional portions proximate the electrical element to insure proper electrical contact between the electrical load line and the electrical element. Additionally, the electrical element may correspondingly have a heightened thickness. As shown, the electrical load line overlies the tethering device proximate the electrical element but does not impede the free movement of the tethering device.

Additionally, a clamping element 36 may be used to clamp the magnetic element in non-magnetically actuated or a magnetically actuated position. The clamping element may be an electrostatic clamping element, a magnetostatic clamping element or a mechanical latching mechanism. Shown in FIG. 1 is an electrostatic clamping electrode that is disposed on the microelectronic substrate 12 and is physically attached to the underside of the tethering device 22. In the electrostatic embodiment, voltage is applied to the clamping electrode to thereby "lock" the magnetic element in a desired position. If the desired position is an open electrical state then the magnetic element is "locked" in the non-magnetically actuated position. In this open "locked" state the application of a magnetic flux field will not result in actuation of the magnetic element and thus the electrical load line will remain in an open state. If the desired position is a closed electrical state then the magnetic element is "locked" in the magnetically actuated position. In this closed "locked" state the magnetic flux field can be eliminated and the magnetic and electrical elements will remain actuated in a position that closes the electrical circuit line. The electrostatic clamping element may be formed from a metal, such as nickel or copper, or the clamping element may be formed from another suitable electrically conductive material, such as doped silicon or polysilicon. Additionally, while the clamping element as shown in FIG. 1 is positioned between the substrate and the magnetic element it is also possible to position the clamping element atop the magnetic element provided that proper electrical insulation is present between the magnetic and clamping elements.

Figure 2:
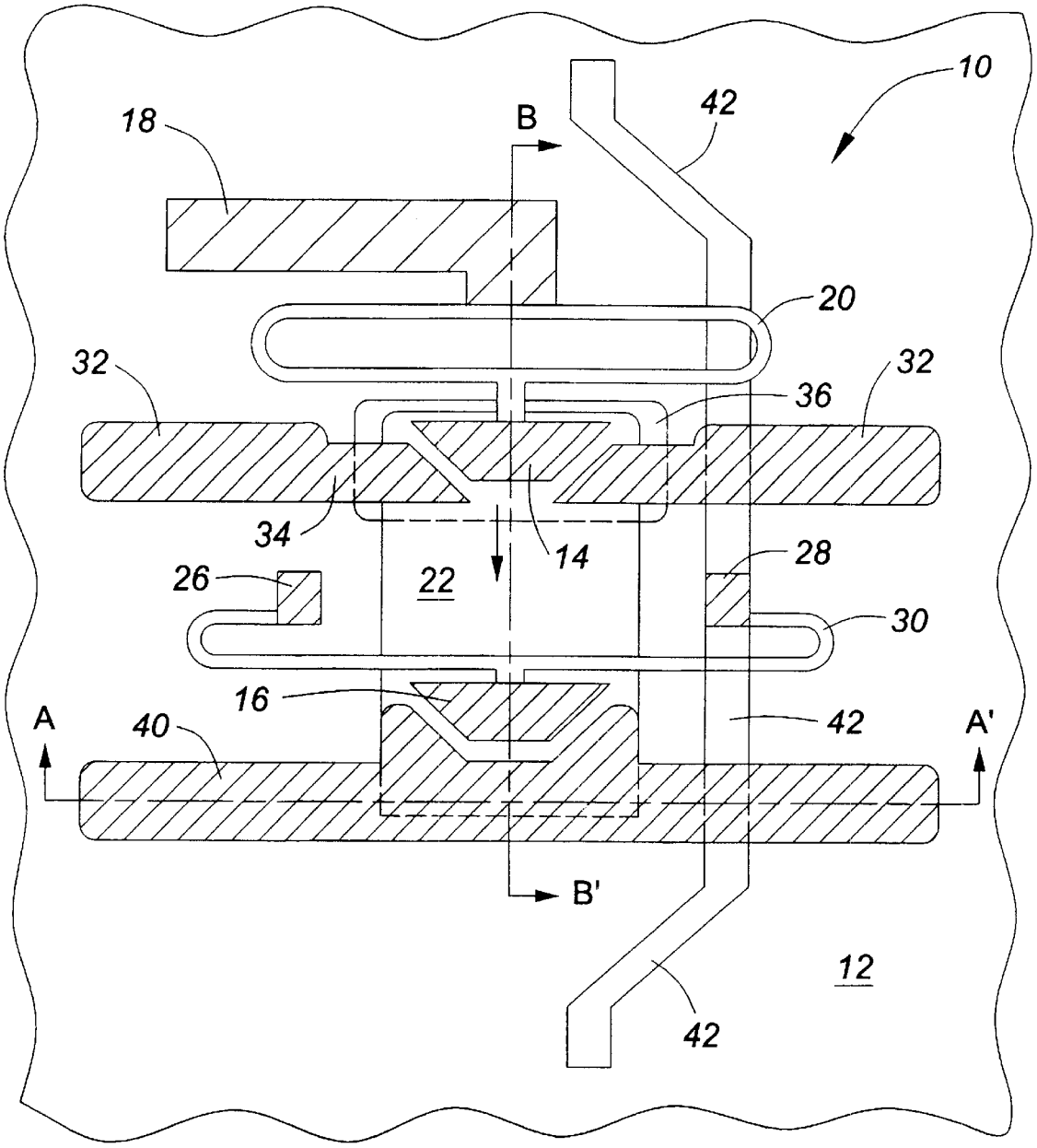
FIG. 2 is a plan view of an in-plane MEMS magnetically actuated switch that switches current from one electrical load line to a second electrical load line, in accordance with an embodiment of the present invention.

FIG. 2 is a plan view illustration of an alternative embodiment of the MEMS magnetically actuated switch in accordance with an embodiment of the present invention. Shown in FIG. 2, the electrical element 16 is capable, upon actuation, of switching electrical current from a first electrical load line 40 to a second electrical load line 42. In this embodiment the second spring-like element 30 serves as the connection between the anchors 26 and 28 and the electrical element, as well as, serving as the electrical connection between the electrical element and the second electrical load line. Anchor 28 is disposed on the second electrical load line and serves as a point of attachment and as an electrical contact. The second spring-like element in this embodiment will be formed of an electrically conductive material, typically a metallic material. The second spring-like element may comprise a c-shaped spring, as shown, or the second spring-like element may comprise another suitable spring-like element capable of providing the necessary elasticity and electrical connection. The first and second electrical lines are typically formed of copper, gold, aluminum or a similar electrical interconnect material. As shown the first electrical line and the second electrical line are disposed on the microelectronic substrate in a generally perpendicular relationship to facilitate the formation of a switching array, however, the first and second electrical lines do not contact except through the activation of the switch. The first and second electrical lines may be disposed in other configuration relationships, such as in parallel, without departing from the inventive concepts herein disclosed.

The FIG. 2 embodiment also may comprise a clamping element 36 that is used to clamp the magnetic element in a non-magnetically actuated or a magnetically actuated position. The clamping element may be an electrostatic clamping element, a magnetostatic clamping element or a mechanical latching mechanism. Shown in FIG. 2 is an electrostatic clamping element that is disposed on the microelectronic substrate 12 and is physically attached to the underside of the tethering device 22. The electrostatic clamping element may be formed from a metal, such as nickel or copper, or the clamping element may be formed from another suitable electrically conductive material, such as doped silicon or polysilicon. While the clamping element as shown in FIG. 2 is positioned between the substrate and the magnetic element it is also possible to position the clamping element atop the magnetic element provided that proper electrical insulation is present between the magnetic and clamping elements.

Figure 3:
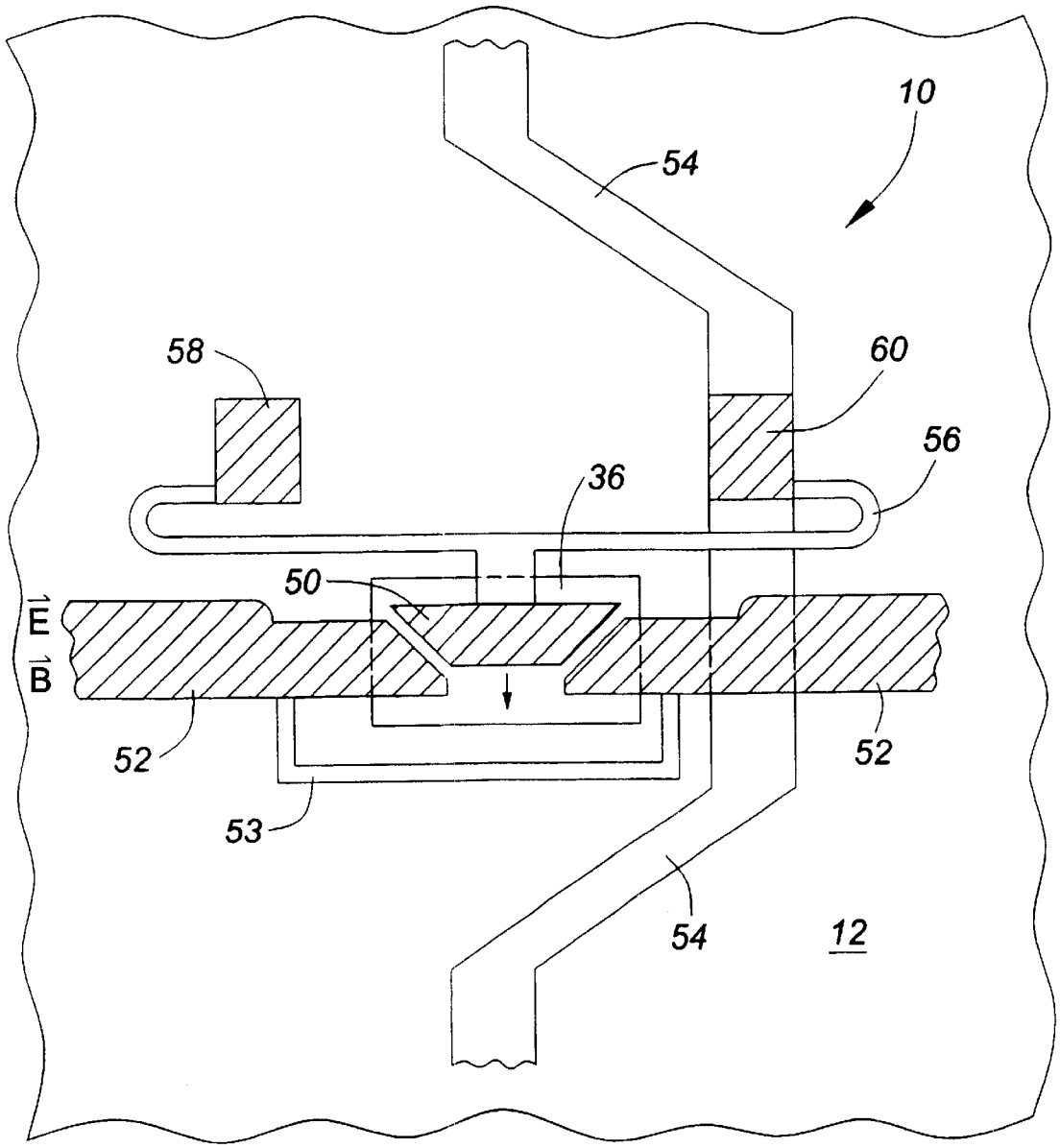
FIG. 3 is a plan view of an in-plane MEMS magnetically actuated switch that includes a shared electrical load path and magnetic flux path, in accordance with an embodiment of the present invention.

Alternatively, as shown in the top view illustration of FIG. 3 it is possible to fabricate the MEMS magnetically actuated switch 10 of the present invention, such that the magnetic flux path and the electrical load line are disposed on the microelectronic substrate and share one common electrically conductive, magnetic element 50. In this embodiment the electrical load line and the magnetic flux path may comprise one singular line 52 capable of both carrying a magnetic field and electrical current. In the embodiment shown the one singular line 52 is an uninterrupted electrical line having a path through the one singular line 52 and the interconnect line 53. Alternatively, a separate electrical load line may underlie or overlie a magnetic flux path. This embodiment eliminates the need to have a separate electrical element and corresponding tethering device. In operation, when a magnetic flux is applied across the line it provides the force necessary to attract the electrically conductive magnetic element toward the magnetic field. This actuation causes the electrically conductive magnetic element to contact the electrical line and switch electrical current from the line to a secondary electrical line 54. In the embodiment in which the electrical load line underlies or overlies the magnetic flux path the electrically conductive magnetic element may comprise a layered composite formed of a magnetic material, such as nickel or nickel/iron, proximate the magnetic flux path, an electrically conductive material, such as gold and an insulating material separating the magnetic material and the electrically conductive material.

In the FIG. 3 embodiment, similar to the embodiment shown in FIG. 2, a spring-like element 56 serves as the connection between the anchors 58 and 60 and the electrically conductive magnetic element 50, as well as, serving as the electrical connection between the element and the second electrical line 54. Anchor 60 is disposed on the second electrical line and serves as a point of attachment and as an electrical contact. The spring-like element in this embodiment will be formed of an electrically conductive material, typically a metallic material. Additionally, a clamping element 36 may be used to provide a clampdown force to the electrically conductive magnetic element. The clamping element may be electrostatic, magnetostatic or a mechanical latching mechanism. In the embodiment shown the clamping element is an electrode attached to the underside of the electrically conductive magnetic element and is typically formed of a conductive metal, such as copper, gold or the like, doped silicon or polysilicon. While the clamping element as shown in FIG. 3 is positioned between the substrate and the electrically conductive magnetic element it is also possible to position the clamping element atop the electrically conductive magnetic element provided that proper electrical insulation is present between the electrically conductive magnetic element and clamping element.

Figure 4:
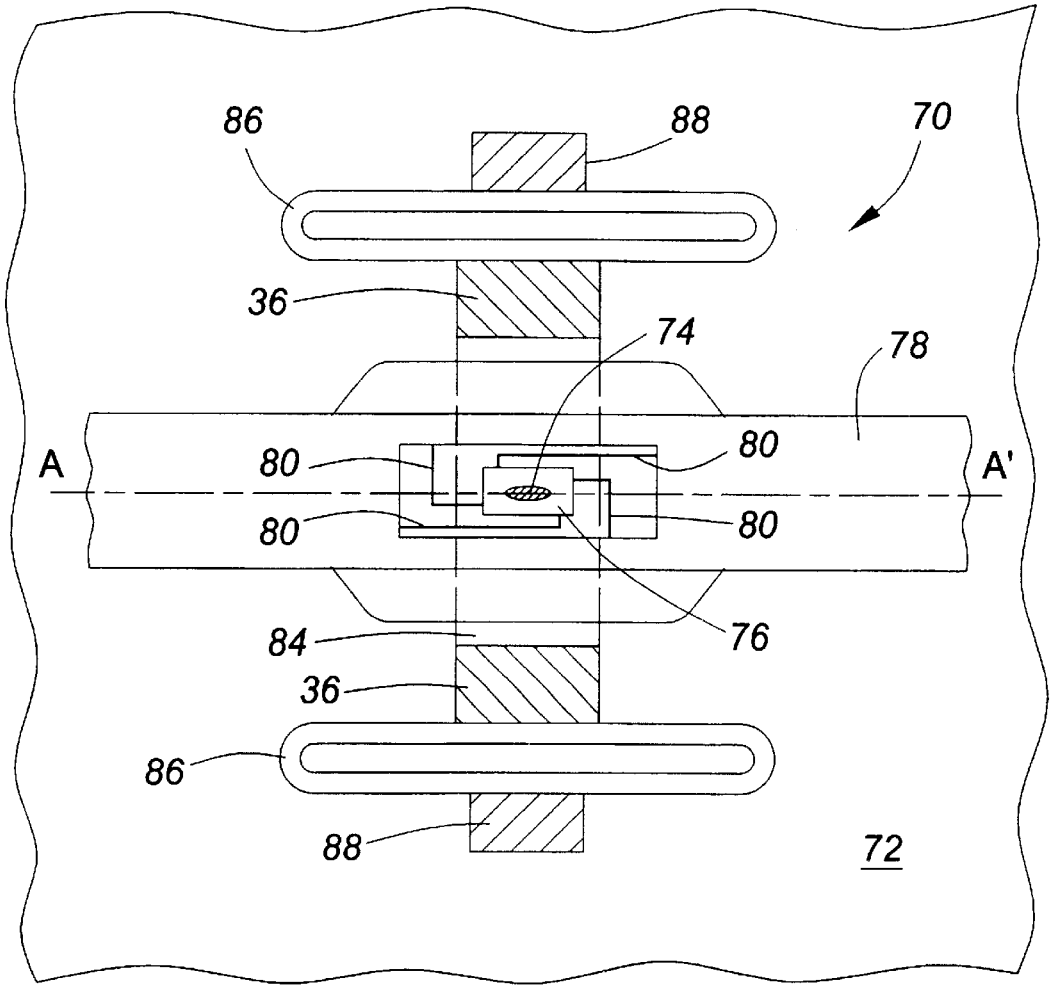
FIG. 4 is a plan view of the first substrate construct of an out-of-plane MEMS magnetically actuated switch utilizing two substrates, in accordance with another embodiment of the present invention.
Figure 5:
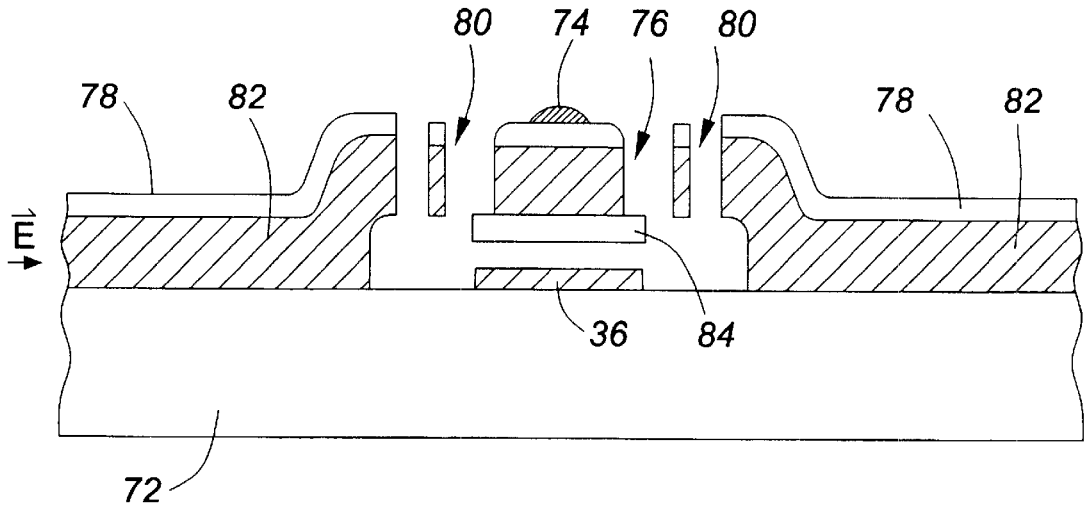
FIG. 5 is a cross-sectional view of the first substrate of an out-of-plane MEMS magnetically actuated switch utilizing two substrates, in accordance with another embodiment of the present invention.

The invention is also embodied in a MEMS magnetically actuated switch that uses two microelectronic substrates. FIGS. 4 and 5 are a plan view and cross-sectional view of the first of two microelectronic substrates used to fabricate a MEMS magnetically actuated switch in accordance with an embodiment of the present invention. The MEMS switch 70 comprises a first microelectronic substrate 72 having a magnetically moveable first electrical contact 74 disposed on the substrate. The contact is disposed on a first contact plate 76. The first contact plate is in electrical communication with the electrical load line 78 via the connecting springs 80. The first microelectronic substrate will typically be formed of silicon or a similar microelectronic substrate material. It is also possible to provide for a magnetic substrate, in which case an insulating layer may be required prior to disposing the electrical load line 78. The first electrical contact 74 may be formed of gold or another suitable electrically conductive material. The first contact plate 76 and connecting springs 80 may comprise a magnetic material, such as nickel or a nickel/iron alloy and will typically be overplated with an electrically conductive material, such as gold. The electrical load line is typically formed of a conductive material, such as gold and overlies a thick layer of magnetic material 82, such as nickel or a nickel/iron alloy. The configuration and quantity of the connecting springs is shown by way of example only. Other connecting spring configurations and quantities are also possible and within the inventive concepts herein disclosed.

Figure 6:
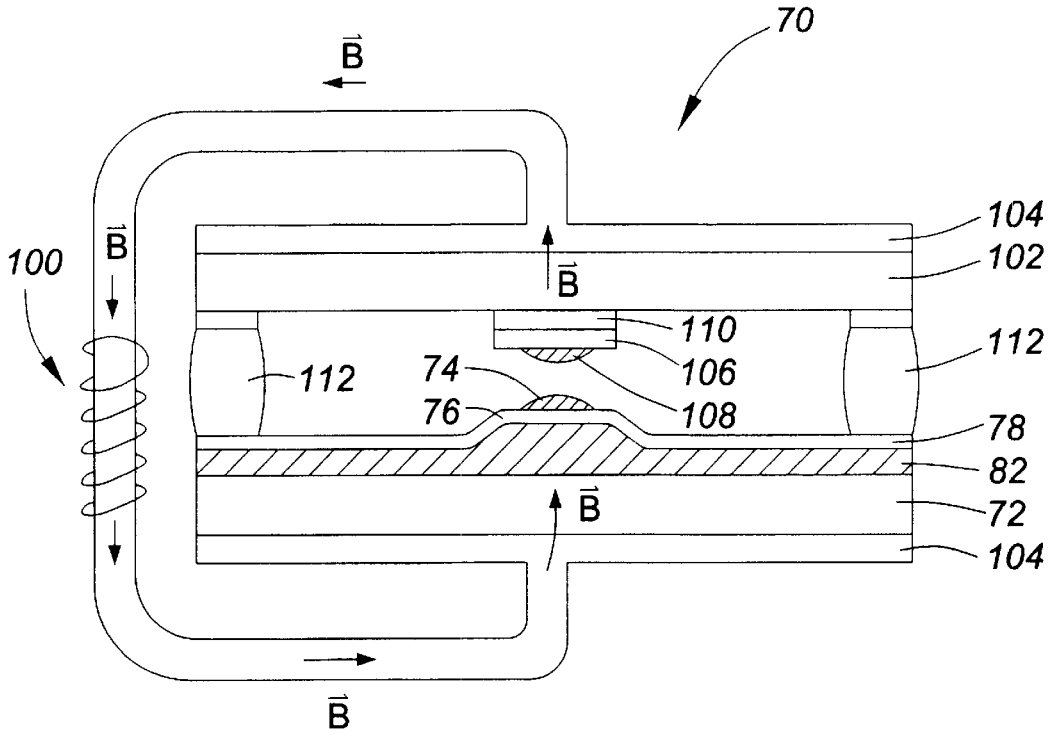
FIG. 6 is a cross-sectional view of the first and second substrates of an out-of-plane MEMS magnetically actuated switch showing the relationship between the substrates and the external magnetic field, in accordance with another embodiment of the present invention.

In operation, a magnetic field source is applied proximate the first microelectronic substrate. The magnetic field source will typically generate a magnetic flux that flows from the bottom-side of the substrate through the substrate, the magnetic material underlying the electrical load line, the spring-like elements and the contact plate to effectuate the upward movement of the contact. This relationship is more readily observed in FIG. 6 that depicts a cross-sectional view of the MEMS magnetically actuated switch 70 having two microelectronic substrates in accordance with an embodiment of the present invention. An external magnetic field source 100 is used to generate a magnetic field. In a preferred embodiment the magnetic field source may be an electromagnet, although other magnetic field source may also be used. The magnetic field source generates a generally circular magnetic field line that enters the switch device from the underside of the first microelectronic substrate 72 and exits the switch at topside of the second microelectronic substrate 102. Typically, magnetic pole pieces 104 will be positioned adjacent to the first and second substrates to strengthen and direct the magnetic field. The magnetic flux flows through the substrate, the magnetic material 82 underlying the first electrical load line 78, the spring-like elements (not shown in FIG. 6) and the first contact plate 76. The force generated by the magnetic flux causes the spring-like elements to move upward, thus, elevating the first contact plate. Upon actuation, the first contact plate 76 and first contact 74 make electrical contact with a corresponding second contact plate 106 and second contact 108 disposed on the second microelectronic substrate. The second contact construct may be generally identical in configuration to the first contact (shown in FIGS. 4 and 5) or the second contact may be a stationary contact that is not actuated by the application of a magnetic field. Once the first contact of the first substrate makes electrical contact with the second contact electrical current from the first electrical load line 78 is switched to second electrical load line 110 disposed on the second substrate. The first and second microelectronic substrates are disposed in a predetermined spaced apart relationship. Support structures 112, such as solder bumps or other known support structures, may be used to create the spaced apart relationship existing between the first and second microelectronic substrates.

Additionally, as shown in FIGS. 4 and 5, clamping elements 36 may be used to clamp the contact plate in a non-actuated or an actuated position. The clamping elements may be an electrostatic clamping element, a magnetostatic clamping element or a mechanical latching mechanism. Shown in FIGS. 4 and 5, an electrostatic clamping electrode 36 is disposed on the microelectronic substrate and generally underlies the first contact plate of the MEMS switch. The placement of the clamping electrode is shown by way of example only, the clamping electrode may also be disposed within the substrate or positioned in other relation in regards to the switch without deviating from the inventive concepts herein disclosed. Once a voltage differential is applied between the first contact plate and the clamping electrode it serves to electrostatically lock the first contact plate in a stationary position that will be unaffected by the force of the magnetic field. The tethering device 84 that is attached to the underside of the first contact plate 76 serves to provide additional resiliency to the first contact plate via the spring-like elements 86. The tether device is attached to the substrate at anchors 88 via spring-like elements 86. In one embodiment, as shown, the spring-like elements may comprise hairpin springs. While a hairpin spring provides the necessary robustness and elasticity, other spring-like elements, such as suspension springs, may also be used to provide the tethering device with a means for motion and a connection to the anchor. The spring-like elements may comprise a polyimide material, a metallic material or any other suitable flexible material. In many instances the resiliency provided by the connecting springs 80 will be sufficient during clamping operation, thus, obviating the need to include a tethering device 84 and spring-like elements 86 when employing a clamping electrode.

In the electrostatic embodiment, voltage is applied to the clamping electrode to thereby "lock" the first contact plate in a desired position. If the desired position is an open electrical state then the first contact plate is "locked" in the non-magnetically actuated position. In this open "locked" state the application of a magnetic flux field will not result in actuation of the first contact plate. The electrostatic clamping element may be formed from a metal, such as nickel or a nickel/iron alloy, or the clamping element may be formed from another suitable electrically conductive material.

In accordance with another embodiment of the present invention, the MEMS magnetically actuated switches may be configured in switching arrays that allow for a single magnetic field source to actuate the individual switches in the array. The single magnetic field source, typically coupled with latchable magnetically actuated switches provides for simplified overall array structures.

Figure 7:
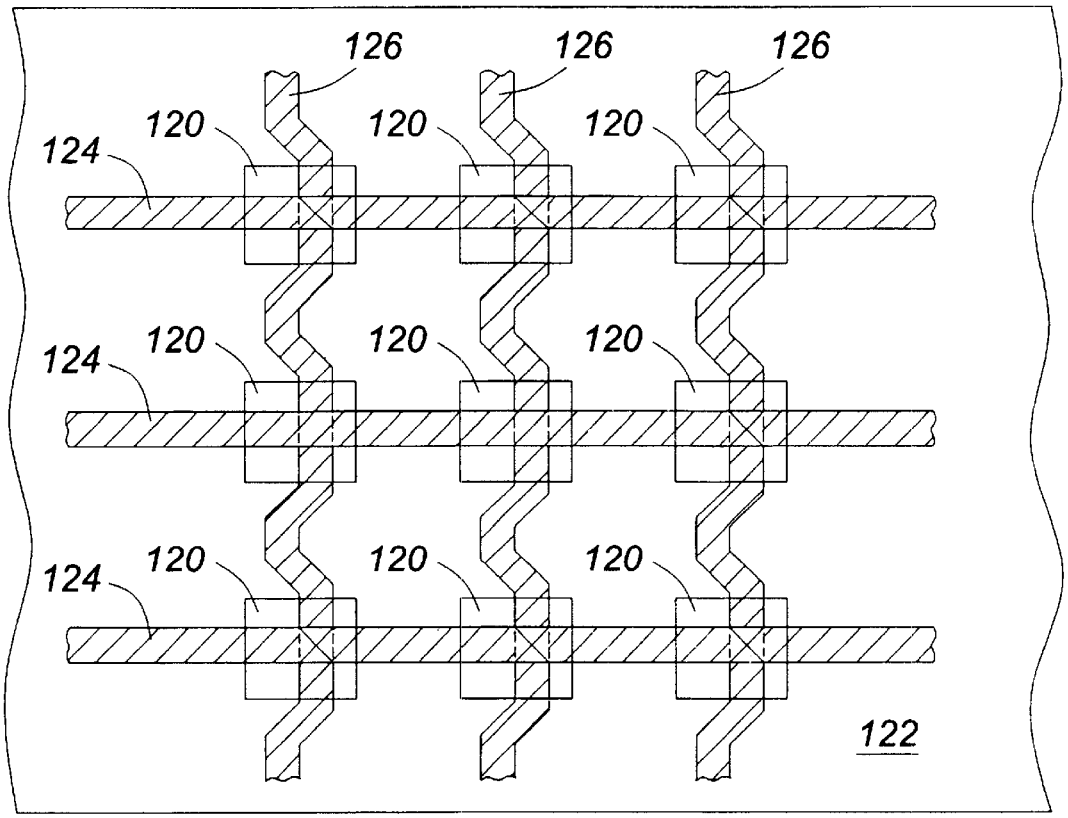
FIG. 7 is a cross-sectional view of an in-plane MEMS magnetically actuated N×N switching array, in accordance with an embodiment of the present invention.

FIG. 7 illustrates a plan view of a simple N×N crosspoint switch array. In the embodiment shown the switches 120 are disposed on the microelectronic substrate 122 at the cross point of a first electrical load line 124 running in a generally horizontal line and a second electrical load line 126 running in a generally vertical line. In operation, the switching array has the capacity to switch current from any one first electrical load line (i.e. an input line) to any one second electrical load line (i.e. an output line) or vice versa depending on current flow directions. By employing the use of clamping elements, individual switches can be "locked" in non-actuated positions so that application of the magnetic field across the array only activates the "unlocked" switches that are free to be actuated. The 3×3 array shown in the illustration is by way of example only. Other array configurations are feasible and the quantity of first electrical load lines may differ from the quantity of second electrical load lines such that the resulting array is asymmetrical.

Figure 8:
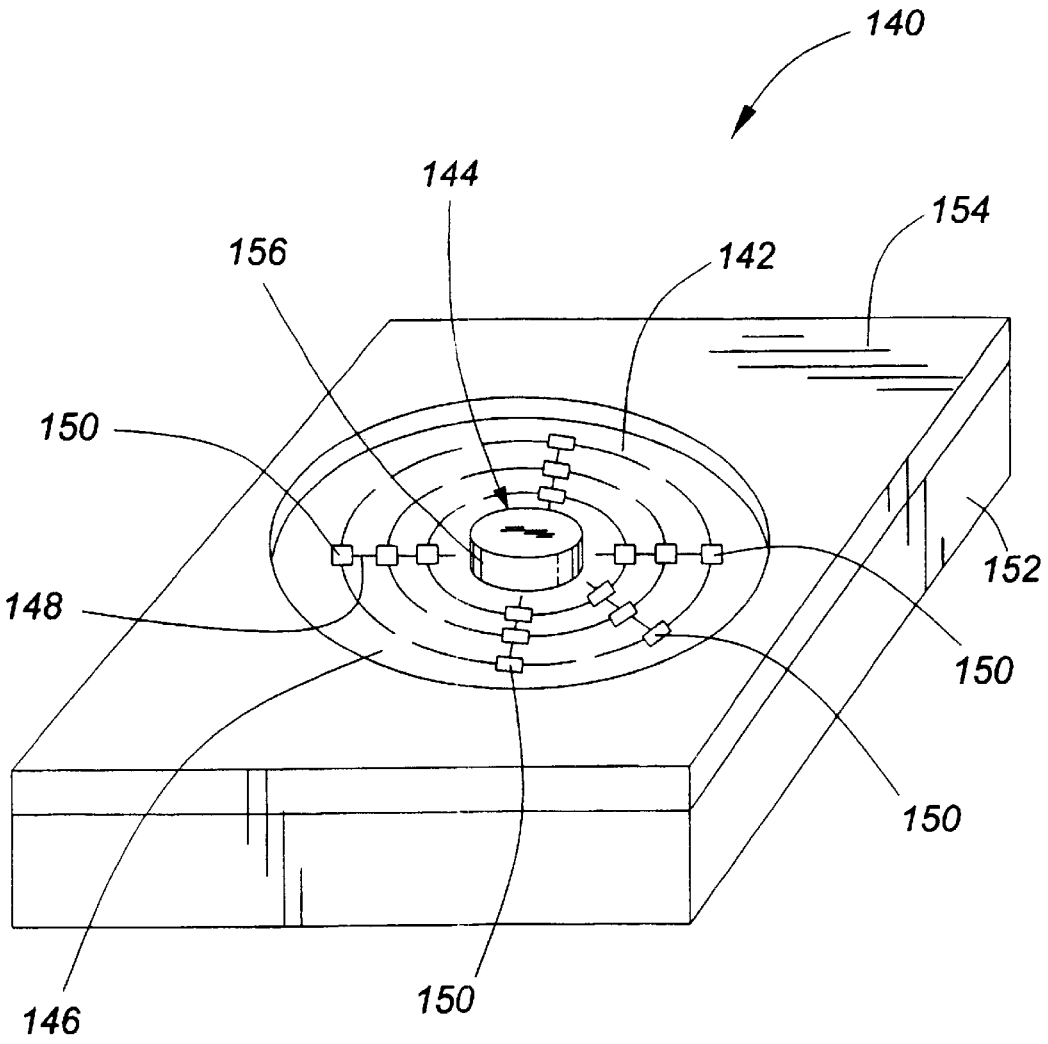
FIG. 8 is a perspective view of an in-plane MEMS magnetically actuated radial switching array, in accordance with an embodiment of the present invention.

FIG. 8 illustrates a perspective view of another MEMS magnetically actuated crosspoint switching array 140 in accordance with an embodiment of the present invention. This embodiment incorporates a radial switching array in which the first electrical load lines 142 are disposed in concentric arcs from a point of reference 144 on the microelectronic substrate 146 and the second electrical load lines 148 extend radially outward from the point of reference. The MEMS magnetically actuated switches 150 of the present invention are disposed at the cross points of the first and second electrical load lines. The magnetic field source 152 may be an electromagnet located, as shown, below the substrate or above the substrate. Other magnetic field sources, such as a permanent magnet may be used and in some instance shading coils may be desired to dissipate the magnetic field. In the embodiment in which the electromagnet is positioned above the substrate it may be necessary to provide the input/output leads with feed-throughs to provide access to pads outside the array structure. The electromagnet may comprise a conventional toriodal core with a bobbin and coil arrangement disposed therein. In the FIG. 8 depiction a magnetic pole piece 154 is positioned around the periphery of the radial array to concentrate the magnetic flux in the desired flux path. The magnetic pole piece is typically formed of nickel, a nickel/iron alloy or a similar magnetic material. At the center point of reference a center pole piece 156 is disposed on the substrate to act as a magnetic field concentrator and insure proper flux paths.

Figure 9A:
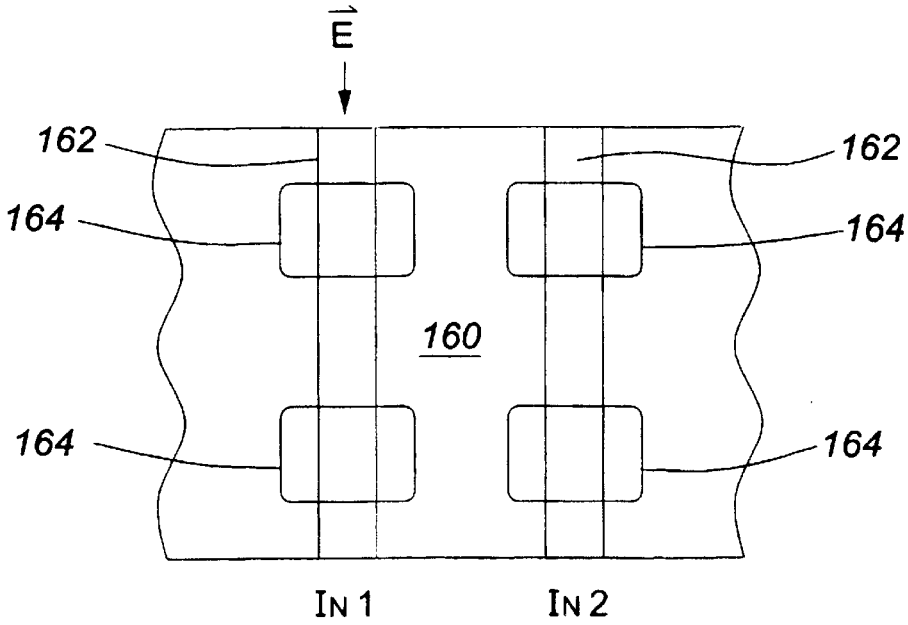
FIGS. 9A and 9B are plan views of the first and second substrates of an out-of-plane MEMS magnetically actuated N×N switching array, in accordance with another embodiment of the present invention.
Figure 9B:
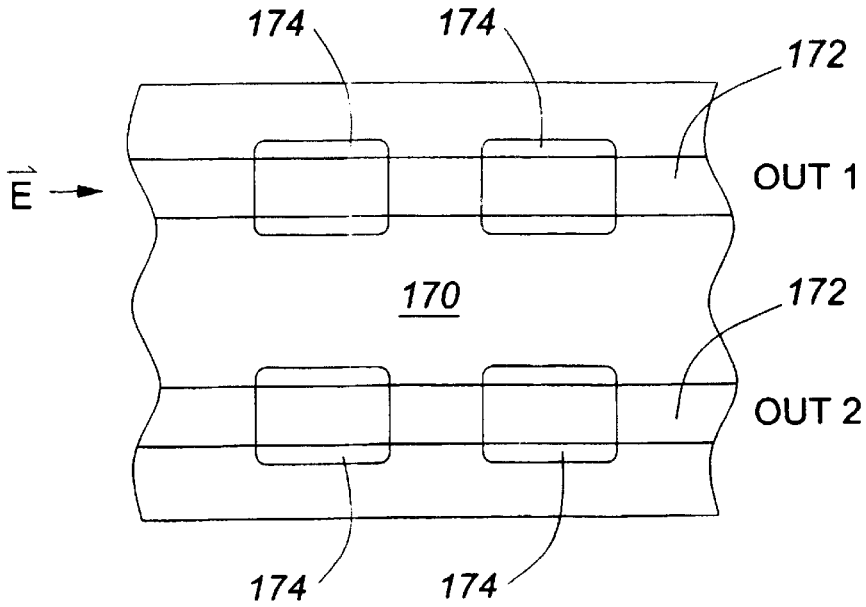

FIGS. 9A and 9B are plan views of the first and second microelectronic substrates comprising another MEMS magnetically actuated crosspoint switching array in accordance with an embodiment of the present invention. FIG. 9A illustrates a first microelectronic substrate 160 and FIG. 9B illustrates a second microelectronic substrate 170. The first microelectronic substrate includes first electrical load lines 162 disposed thereon and MEMS magnetically actuated switches 164 disposed within the first electrical load lines. The first electrical load lines may be electrical input lines, as depicted. As discussed previously, in the dual substrate embodiment the magnetic actuation of the first substrate switch moves the first contact in an out-of-plane direction, generally perpendicular to the first substrate. Upon actuation the first contact makes electrical connection with a corresponding second contact disposed on the second substrate. The second microelectronic substrate includes second electrical load lines 172 disposed thereon and either stationary contact plates 174 or MEMS magnetically actuated switches 174. The second electrical load lines may be electrical output lines, as depicted. In the dual substrate embodiment the second contact may be stationary or the second contact may be magnetically actuated. The first and second microelectronic substrates are in a spaced apart relationship, such that, each switch on the first substrate corresponds to a contact plate or switch on the second substrate. The spaced apart relationship can be created by various support structures, such as solder bumps. By employing the use of clamping elements on the individual switches it is possible to "lock" switches in an open position prior to application of the magnetic field to thereby selectively choose those switches that will be active and those switches that will be inactive.

Figure 10A:
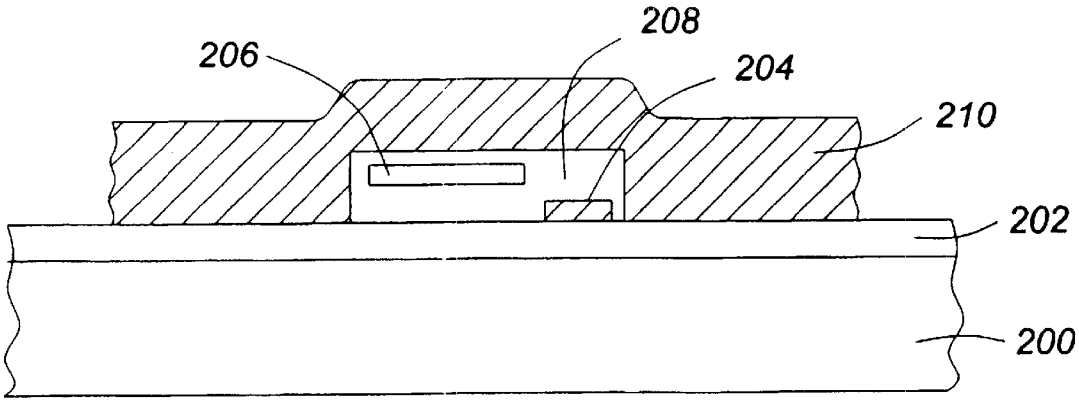
FIGS. 10A and 10B are cross-sectional views of the in-plane MEMS magnetically actuated switch that switches current from one electrical load line to a second electrical load line, in accordance with an embodiment of the present invention.
Figure 10B:
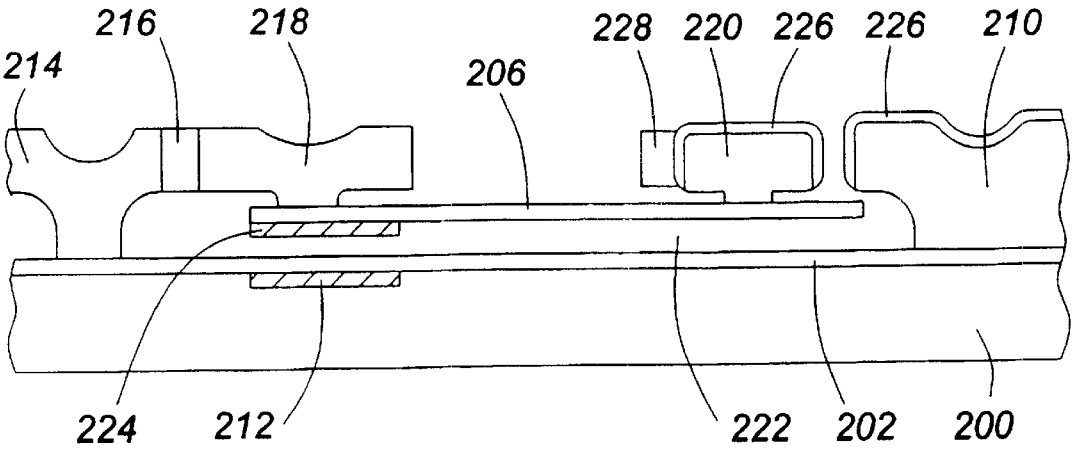

The invention is also embodied in methods for fabricating the MEMS magnetically actuated switches. FIGS. 10A–10B depict two cross-sectional views of the MEMS magnetically actuates switches shown in FIG. 2. FIG. 10A is a cross-sectional view of the MEMS switch through the A—A line and FIG. 10B is a cross-sectional view of the MEMS switch through the B—B line. Referring to FIG. 10A, a microelectronic substrate 200 has a thin dielectric layer 202 disposed thereon. The microelectronic substrate may comprise silicon, quartz, aluminum, glass or any other suitable microelectronic substrate material. It is also possible to use a magnetic material for the substrate, such as ferrite nickel, if a non-magnetic dielectric layer is disposed on the substrate. The dielectric layer may comprise silicon nitride, silicon oxide or any other suitable dielectric material. The dielectric layer is typically disposed on the substrate via the use of conventional chemical vapor deposition (CVD) techniques. The dielectric layer serves to isolate the electrical load line conductor metals from the substrate. The second electrical load line 204 (the vertical load line in FIG. 2) is disposed on the substrate by standard patterning and etch procedures. The second electrical load line may comprise any conductive material, such as doped-silicon, copper, aluminum or the like. The dielectric tether device 206 is disposed within the material-free region 208 located above the substrate. The material-free region is created by disposing sacrificial layers during processing that are subsequently removed to allow for certain predetermined structures to be free to move in prescribed directions. The dielectric tether may be formed of silicon nitride or any other suitable dielectric material may be used. The first electrical load line 210 (the horizontal load line in FIG. 2) is disposed on the substrate and above the tethering device. The first electrical load line may comprise any conductive material, such as copper, nickel, aluminum or the like. Typically, the first electrical load line will be overplated with a thin layer of metallic material (not shown in FIG. 10A), such as gold or the like, to insure low electrical resistance at the point of contact.

Referring to FIG. 10B, similar to the FIG. 10A depiction the microelectronic substrate 200 has a thin dielectric layer disposed thereon 202. Also, shown in this illustration, intermediate the substrate and the dielectric layer is a clamping electrode layer 212 that is disposed on the substrate. The clamping electrode layer in the substrate is used in unison with the magnetic element or an optional clamping electrode 224 to create the clamping force. In certain embodiments in which the substrate is conductive the use of the buried clamping electrode in the substrate will not be required. The clamping electrode typically comprises a strong conductive material such as copper or the like. An anchor 214 is disposed on the substrate that serves to support the tethering device and provide clamping voltage to the clamping element. The anchor will be formed of a conductive material such as nickel or the like. A spring-like element 216 will be affixed to the anchor and the magnetic element 218. The spring-like element provides a means for free movement of the tethering device and will typically be formed of a flexible, conductive material, such as polysilicon or a similar material. The magnetic element 218 will comprise a magnetic material, such as nickel, a nickel/iron alloy or the like. The dielectric tethering device 206 is disposed above and released from the microelectronic substrate. The tethering device serves as a platform for the magnetic element and the electrical element 220. The material-free region 222 below the tethering device is formed during fabrication by a sacrificial layer. The material-free-region serves to provide free movement to the tethering device. An optional clamping electrode 224 is disposed below and physically attached to the tethering device. The clamping electrode will typically comprise a strong conductive material, such as copper or the like. In embodiments in which the clamping electrode is disposed on the substrate, the magnetic element 218 and the clamping element may serve to provide electrostatic clamping capabilities; obviating the need to include the clamping electrode layer 212 in the substrate. The electrical element 220 is disposed on the tethering device and is typically formed of a metallic conductor, such as nickel, gold, copper or alloys of the same. The electrical element is typically overplated with a low resistance material 226, such as gold, to insure proper electrical contact. A spring-like element 228 is attached to the electrical element and connects with the substrate and second electrical load line (not shown in FIG. 10B). The first electrical load line 210 is disposed on the microelectronic substrate in close proximity to the electrical element such that actuation of the magnetic element causes the connected electrical element to contact the first electrical load line 210.

Figure 11A:
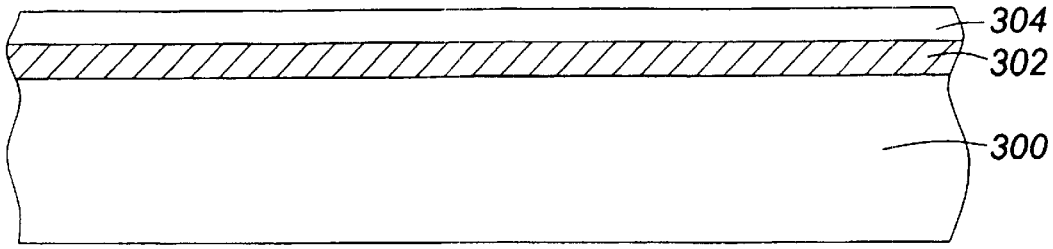
FIGS. 11–11E are cross-sectional views of various stages in the fabrication of the in-plane MEMS magnetically actuated switch, in accordance with an embodiment of the present invention.
Figure 11B:
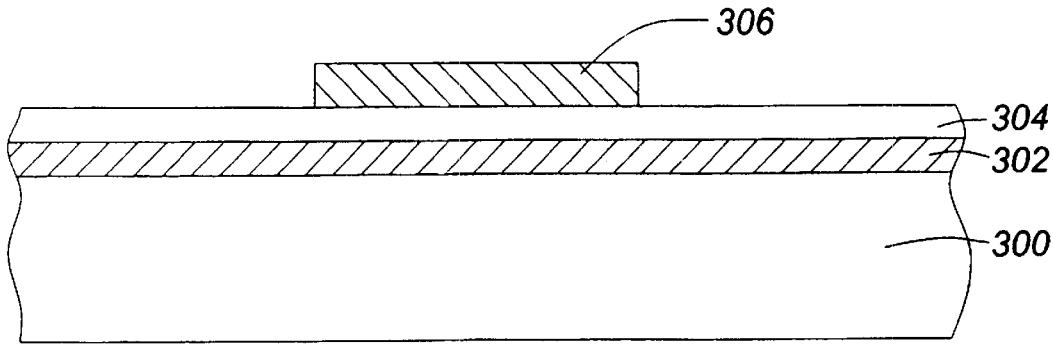

FIGS. 11A–11E are cross-sectional views of various steps in the fabrication of the MEMS magnetically actuated switch in accordance with yet another embodiment of the present invention. Shown in FIG. 11A, is a microelectronic substrate 300 having a ground clamp electrode layer 302 and a dielectric layer 304 disposed thereon. The microelectronic substrate may comprise silicon, quartz, aluminum, glass or any other suitable microelectronic substrate material. It is also possible to use a magnetic material for the substrate, such as ferrite nickel, if a non-magnetic dielectric layer is disposed on the substrate. The ground clamp electrode is typically formed from a metallic material, such as copper, nickel or the like, and is disposed by conventional diffusion or deposition techniques. FIG. 11B illustrates the MEMS magnetically actuated switch construct after a first conductive layer 306 has been deposited, patterned and etched to define the second electrical load line (i.e. the vertical load line in FIG. 2). The conductive layer may comprise a suitable conductive material, such as doped-silicon, copper or the like.

Figure 11C:
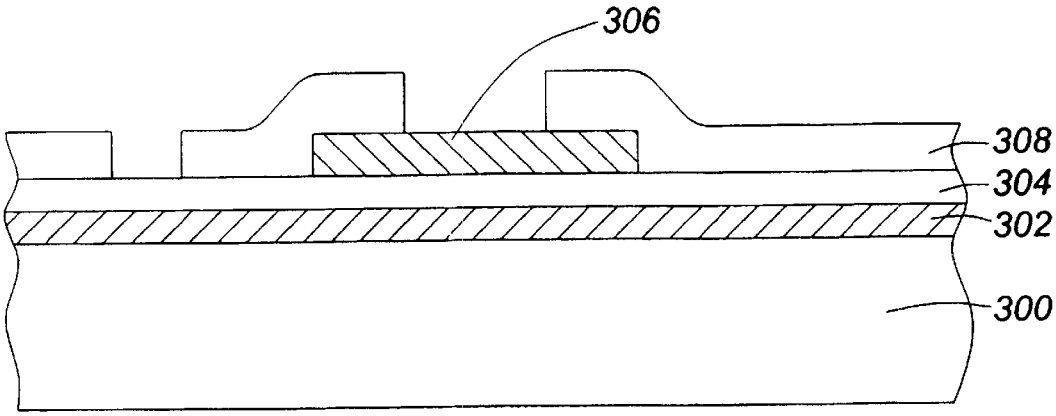
Figure 11D:
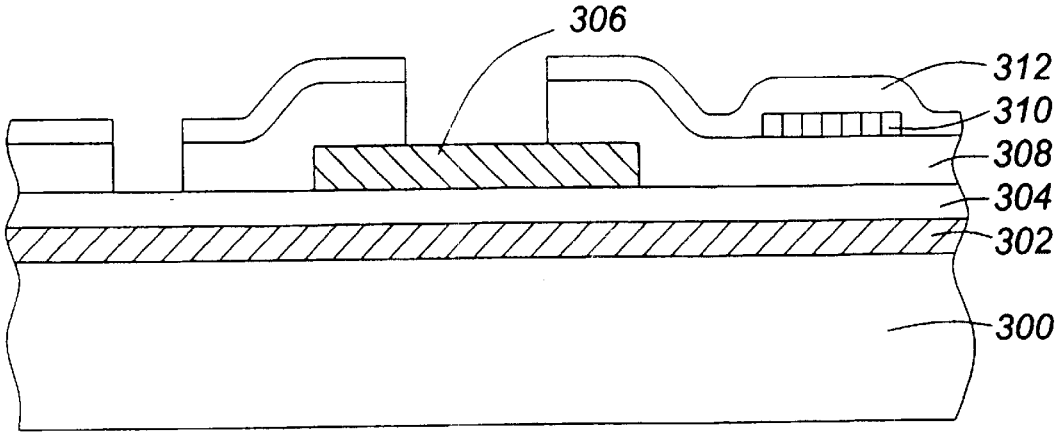

FIG. 11C depicts the MEMS magnetically actuated switch after a first sacrificial layer 308 has been deposited, patterned and etch to define the areas where the anchor will connect with the substrate. The sacrificial layers will typically comprise a low temperature oxide material disposed by conventional LPCVD techniques and will subsequently be removed to release predetermined elements from the substrate. Shown in FIG. 11D is the MEMS switch construct after a dielectric layer 310 has been deposited, patterned and etched to define the dielectric tether device. Typically the dielectric layer will comprise silicon nitride or another suitable non-magnetic dielectric material may be used. After deposition of the dielectric layer, a second sacrificial layer 312 is deposited, patterned, and etched to define the areas on the tether device where the magnetic and electrical elements will be formed.

Figure 11E:
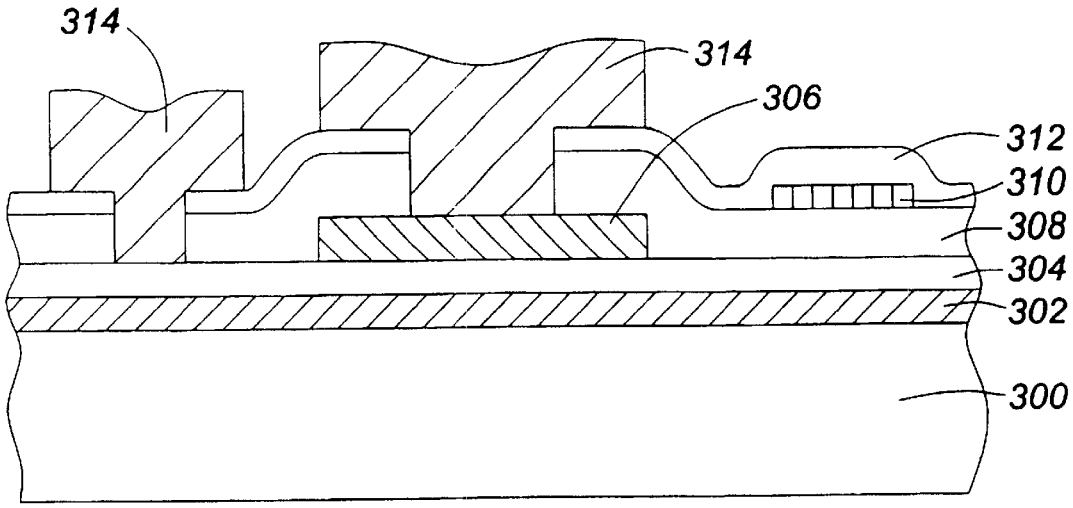

Referring to FIG. 11E, shown is the MEMS magnetically actuated switch after a magnetic layer 314 has been deposited, patterned, and etched to define the anchor structures and the magnetic element. Typically, the magnetic layer will comprise nickel, nickel/iron alloy or a similar magnetic material. After the magnetic layer is disposed and defined, a second conductive layer (not shown in FIG. 11E) is deposited, patterned and etched to define the first electrical load line (i.e. the horizontal load line in FIG. 2) and the electrical element. The second conductive layer is typically formed from copper, nickel, aluminum or the like. After formation of the switch elements, a release operation removes the sacrificial layers to provide mobility to the tethering device.

As such, the present invention is capable of providing for a MEMS magnetically actuated switch and corresponding switching arrays that are capable of individual activation in a single magnetic field environment. By implementing clamping elements the switches can be individually addressable in an array configuration. This benefit can be realized in easier fabrication of large scale switching arrays that occupy less space on the microelectronic substrate. Additionally, the present invention provides for embodiments that impart both in-plane and out-of-plane actuation.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A MEMS electrical cross-point switch comprising:

a microelectronic substrate;

a first line that is electrically and magnetically conductive;

a second line that is electrically conductive;

a magnetic element disposed on the microelectronic substrate and configured to move in a predetermined direction in response to a magnetic field to selectively switch electric current from the first line to the second line through the magnetic element; and a clamping element on the microelectronic substrate, the clamping element having a first state in which the magnetic element is held in a first position spaced-apart from at least one of the first and second lines and having a second state in which the magnetic element is held in a second position in electrical contact with the first and second lines when the magnetic field is eliminated.

2. The MEMS electrical cross-point switch of claim 1, further comprising:

a clamping element disposed on said microelectronic substrate and configured to clamp the magnetic element in position.

3. The MEMS electrical cross-point switch of claim 2, wherein said clamping element comprises a clamping electrode that is configured to provide a voltage to clamp said magnetic element in position.

4. The MEMS electrical cross-point switch of claim 2, wherein said clamping element comprises a clamping pole that is configured to provide a magnetic field to clamp said magnetic element in position.

5. The MEMS electrical cross-point switch of claim 2, wherein said clamping element comprises a mechanical clamp that is configured to provide a mechanical force to clamp said magnetic element in position.

6. The MEMS electrical cross-point switch of claim 1, further comprising:

a magnetic flux path disposed on said microelectronic substrate and selectively in magnetic circuit with said magnetic element and that is configured to switch electric current from the first line to the second line.

7. The MEMS electrical cross-point switch of claim 6, wherein said magnetic flux path is positioned in relation to said magnetic element such that applying the magnetic field to said magnetic flux path will attract said magnetic element so as to move said magnetic element and thereby selectively switch electric current from the first line to the second line.

8. The MEMS electrical cross-point switch of claim 6, wherein said magnetic flux path is generally perpendicular to the predetermined direction of movement of said magnetic element.

9. The MEMS electrical cross-point switch of claim 6, wherein said magnetic flux path is generally parallel to the predetermined direction of movement of said magnetic element.

10. A MEMS electrical switching array comprising:

a microelectronic substrate;

a magnetic field source;

a plurality of first and second lines disposed on the microelectronic substrate in an array formation, wherein said plurality of first lines are electrically and magnetically conductive;

a plurality of MEMS electrical cross-point switches disposed on the microelectronic substrate, wherein each MEMS electrical cross-point switch comprises a magnetic element disposed on the microelectronic substrate and configured to move in a predetermined direction in response to a magnetic field from the magnetic field source applied through the magnetic element to selectively switch electric current from a one of the plurality of first lines to one of the plurality of second lines through the magnetic element; and a clamping element, on the microelectronic substrate, the clamping element having a first state in which the magnetic element is held in a first position spaced-apart from at least one of the first and second pluralities of lines and having a second state in which the magnetic element is held in a second position in electrical contact with the first and second pluralities of lines when the magnetic field is eliminated.

11. The MEMS electrical switching array of claim 10, wherein said plurality of MEMS electrical cross-point switches are individually located proximate to an intersection of one of the plurality of first lines and one of the plurality of second.

12. The MEMS electrical switching array of claim 10, wherein said plurality of first and second lines are positioned on said microelectronic substrate such that said plurality of first lines define respective rows of first lines and said plurality of second lines define respective columns of second lines.

13. The MEMS electrical switching array of claim 1, wherein said rows of first lines and said columns of second lines intersect in a generally perpendicular relationship.

14. The MEMS electrical switching array of claim 12, wherein said rows of first lines extend radially from a central point of reference of said microelectronic substrate and said columns of second lines extend in arcs around the central point of reference to intersect said rows of first lines.

15. The MEMS electrical switching array of claim 14, wherein said central point of reference further comprises a magnetic pole piece.

16. The MEMS electrical switching array of claim 16, wherein said plurality of MEMS electrical cross-point switches further comprise a clamping element disposed on said microelectronic substrate and configured to clamp the magnetic element in position.

17. The MEMS electrical switching array of claim 16, wherein said clamping element comprises a clamping electrode that is configured to provide a voltage to clamp said magnetic element in position.

18. The MEMS electrical switching array of claim 16, wherein said clamping element comprises a clamping pole that is configured to provide a magnetic field to clamp said magnetic element in position.

19. The MEMS electrical switching array of claim 16, wherein said clamping element comprises a mechanical clamp that is configured to clamp said magnetic element in position.

20. The MEMS electrical switching array of claim 10, further comprising:

at least one magnetic flux path disposed on said microelectronic substrate and selectively in magnetic circuit with the magnetic element of said plurality of MEMS electrical cross-point switches to switch electric current from one of the plurality of first lines to one of the plurality of second lines.

21. The MEMS electrical switching array of claim 20, where said at least one magnetic flux path is generally perpendicular to the direction of the movement of said magnetic element of said plurality of MEMS electrical cross-point switches.

22. The MEMS electrical cross-point switch of claim 1 wherein a magnetic flux path of the magnetic field and an electric current path of the electrical current include the first and second lines.

23. The MEMS electrical switching array of claim 10 wherein a magnetic flux path of the magnetic field and an electric current path of the electrical current include the first and second lines.

* * * * *